US006948485B2

(12) United States Patent
Krüger et al.

(10) Patent No.: US 6,948,485 B2
(45) Date of Patent: Sep. 27, 2005

(54) IGNITION UNIT FOR INTERNAL COMBUSTIONS ENGINES

(75) Inventors: Andreas Krüger, Hamburg (DE); Bernhard Auler, Hamburg (DE)

(73) Assignee: Dolmar GmbH, Hamburg (DE)

( * ) Notice: Subject to any disclaimer, the term of this patent is extended or adjusted under 35 U.S.C. 154(b) by 64 days.

(21) Appl. No.: 10/226,808

(22) Filed: Aug. 23, 2002

(65) Prior Publication Data

US 2003/0051706 A1 Mar. 20, 2003

(30) Foreign Application Priority Data

Sep. 14, 2001 (DE) ..... 101 45 541

(51) Int. Cl.[7] ..... F02P 1/08
(52) U.S. Cl. ..... 123/599; 123/605
(58) Field of Search ..... 123/406.45, 406.56, 123/599, 605, 650, 651

(56) References Cited

U.S. PATENT DOCUMENTS

| | | | | |
|---|---|---|---|---|
| 4,163,437 A | | 8/1979 | Notaras | 123/148 |
| 4,342,304 A | * | 8/1982 | Watanabe | 123/599 |
| 4,381,752 A | * | 5/1983 | Hill | 123/599 |
| 5,161,496 A | * | 11/1992 | Matsushima et al. | 123/599 |
| 5,172,675 A | * | 12/1992 | Kurosu et al. | 123/599 |

FOREIGN PATENT DOCUMENTS

| | | |
|---|---|---|
| DE | 3248388 A1 | 7/1983 |
| DE | 3401449 A1 | 7/1984 |
| DE | 19524259 A1 | 1/1997 |

* cited by examiner

*Primary Examiner*—Erick Solis
(74) *Attorney, Agent, or Firm*—Nash and Titus, LLC

(57) ABSTRACT

The invention is relative to an ignition unit for internal combustion engines that comprises a primary circuit with a first switch for a primary winding for generating inductions in a secondary winding of a secondary circuit with a starter gap and that comprises a load circuit with the primary winding and comprises a second switch for a load.

12 Claims, 1 Drawing Sheet

IGNITION UNIT FOR INTERNAL COMBUSTIONS ENGINES

FIELD OF THE INVENTION

The invention relates to an ignition unit device (e.g., igniter) for internal combustion engines.

This application claims priority from German application FRG 101 45 541.0, filed Sep. 14, 2001.

BACKGROUND OF THE INVENTION

Many different ignition units for internal combustion engines are found in the state of the art.

DE 33 19 952 C2 discloses an ignition unit whose secondary coil is tapped. The tapping of the secondary coil serves to resolve the contradiction of supplying the greatest possible discharge current to the ignition stretch, that is, that the winding ratio of the secondary winding to the primary winding must be small, and of supplying a high voltage to the ignition unit in order to penetrate the insulation of the starter gap, that is, that the winding ratio of the secondary winding to the primary winding must be great.

DE 25 31 337 C3 discloses an ignition unit whose primary winding is tapped. The tapping of the primary coil serves to form a shunt branch and to remove the load on the ignition coil.

The ignition units cited in the state of the art have the disadvantage of not utilizing the energy in the regulated breakaway range of the ignition unit.

SUMMARY OF THE INVENTION

The present invention addresses the problem of improving the known ignition units for internal combustion engines.

The invention solves this problem with an ignition unit for internal combustion engines that comprises a primary circuit with a first switch for a primary winding for generating inductions in a secondary winding of a secondary circuit with a starter gap. The ignition unit further comprises a load circuit with at least one of the two windings, and further comprises a second switch for a load (consuming device).

DETAILED DESCRIPTION OF THE PREFERRED EMBODIMENTS

Figure 1:
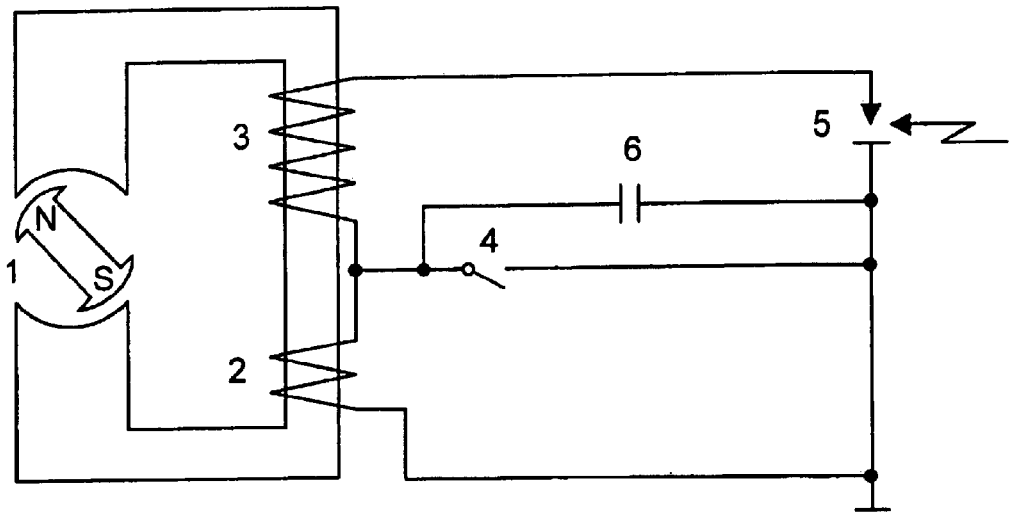
Fig. 1 (PRIOR ART)
FIG. 1 is a circuit diagram of a known ignition unit of the prior art.

The primary winding and the secondary winding can be arranged on a core, preferably a soft iron core. The arrangement can cooperate with a movable magnet. The movable magnet is preferably designed as a rotatable magnet wheel (e.g., field spider) that induces an alternating voltage in the primary and in the secondary winding.

A possible arrangement with primary winding, secondary winding and optionally a part of the movable magnet, especially of the magnet wheel and with a core forms a magnetic circuit.

Even the alternating voltage generated in the secondary winding can be rendered utilizable for a load.

It is basically also conceivable to operate the ignition unit of the invention with a direct voltage. To this end a direct-voltage source can be provided in the primary circuit.

The problem in the art is preferably solved by an ignition unit for internal combustion engines that comprises: a primary circuit with a first switch for a primary winding for generating inductions in a secondary winding of a secondary circuit with a starter gap; a load circuit with the primary winding; and a second switch for a load. It is advantageous if the load circuit does not comprise the secondary winding.

A flow of current can be generated in the primary circuit by closing the first switch. A magnetic field builds up thereby in the primary winding. The magnetic field of the primary winding preferably collapses by the sudden opening of the first switch and the magnetic change in flux induces a secondary voltage in the secondary winding. This secondary voltage is preferably so great that the resistance (resistor) of the starter gap can be overcome. The primary current breaking down or weakening after the opening of the first switch in the primary circuit can be conducted into a quench capacitor in a preferred embodiment of the ignition unit. However, it is also conceivable to do without the quench capacitor or to replace it by other, preferably capacitive components.

The ignition unit comprises a second switch with which the load circuit with a load can be closed. The first switch and the second switch are preferably coupled. The ignition unit preferably comprises an operating range and a regulated range (or a regulating or breakaway range) and the first switch opens and closes the primary circuit in the operating range and the second switch opens and closes the load circuit in the regulated range.

The term "operating range of the ignition unit" denotes in this connection the work range of the ignition unit in which basically one ignition takes place per work cycle of the internal combustion engine. Basically, no more ignition takes place in the regulated range of the ignition unit.

The first switch and/or the second switch is/are preferably designed as an electronic switch. Such a design is especially advantageous for the first switch because, e.g., in a two-cycle engine one ignition of the fuel-air mixture takes place per revolution of the crankshaft. Thus, the number of changes in the switching state of the first switch corresponds to the potentially very high (several thousand revolutions per minute) speed of the crankshaft. The load on a mechanical switch would therefore be high. Basically, the changes in the switching state of all switches described here can also be carried out by the back-and-forth movement of a mechanical switch.

The coupling between the first and the second switch is preferably such that the second switch can be closed when the first switch is opened. In a favorable embodiment of the invention the second switch can basically be closed only in the regulated range of the ignition unit.

In the operating range the primary current is necessary for influencing the magnetic circuit. An additional load might be able to sharply reduce the primary circuit and bring about a weakening of the ignition spark as a consequence.

A high primary current is not required in the regulated range for the generation of the ignition spark. The primary current can preferably be used in this regulated range of the ignition unit for another load.

It is advantageous if the ignition unit comprises a three-state switch that comprises the first and the second switch. This three-state switch alternates in the operating range between a primary state for closing the primary circuit and a zero (or neutral) state and alternates or changes in the regulated range to a load state for cutting in the load. In the zero state current flows neither through the primary circuit nor through the load.

In the operating range the three-state switch alternates back and forth in accordance with the speed of the internal combustion engine between the primary state and the zero state. During the transition from the primary state to the zero state the primary circuit is interrupted and an ignition voltage is induced in the secondary coil. After the alternation from the zero state to the primary state current can again flow in the primary winding. In the regulated range the three-state switch alternates out of the zero state into the load state. The three-state switch remains preferably during the entire time in which the ignition unit is regulated in the load state. The load can thus be constantly supplied with current with the ignition unit regulated.

The ignition unit of the invention thus makes a voltage source available, especially in the time sections in which the ignition unit is regulated. Basically, another load can be fed by this voltage source. The ignition unit of the invention is especially advantageous for small apparatuses comprising internal combustion engines. The ignition unit of the invention is particularly advantageous for manually guided small apparatuses, especially chain saws and motor-driven scythes. Such small apparatuses basically have little space available for receiving additional voltage sources. The ignition unit of the invention requires in a favorable instance only another current conduction in order to make an additional voltage source available. This voltage source can be tapped in particular in the housings of small apparatuses.

A voltage preparation circuit can be provided between the primary coil and the load. The voltage preparation circuit can comprise a voltage rectifier and/or a voltage limiter.

In one embodiment of the invention a magnet wheel generates the primary current. This magnet wheel is preferably driven by the shaft of the internal combustion engine. An alternating magnetic field can be produced, preferably in a soft iron core. The alternating magnet field generates the primary current in the form of an alternating current by induction in the primary coil. The speed of the magnetic wheel is preferably coordinated with that of the number of switching state changes of the first switch between the primary state and the zero state. In two-cycle engines the two numbers or speeds agree per time unit. The coordination takes place preferably by an electronic circuit.

In an especially preferred embodiment of the invention the load comprises a control device for the fuel supply of the internal combustion engine. In the regulated range of the ignition unit the internal combustion engine requires a lesser supply of fuel. The fuel supply can therefore be reduced in the regulated range. This preferably takes place via a control device. The ignition unit of the invention cuts in the control device in the regulated range. The utilization times of the control devices thus correspond essentially to the times in which the ignition unit is in the regulated range. In a favorable instance the control device comprises a magnet valve. However, other control devices are also conceivable.

In an especially preferred embodiment the primary winding and the secondary winding of the ignition unit comprise a first and a second end and the second end of the primary winding is electrically connected to the first end of the secondary winding and the second end of the secondary winding is electrically connected via the starter gap and the quench capacitor to the second end of the primary winding and to the first end of the secondary winding and the three-state switch is connected in the primary state in parallel to the quench capacitor and in the load state in series to the voltage preparation circuit, that is electrically connected to the load. This circuit can be produced by a simple modification of a circuit in accordance with the state of the art.

In another preferred embodiment of the ignition unit of the invention a load winding for another load is provided. The other load and the load can be identical. The load winding is designed for the current and voltage requirements of the other load. The load winding can be a part of the primary winding or be arranged adjacent to the primary winding as a separate winding.

The ignition unit in accordance with the invention can basically be installed in four-cycle as well as in two-cycle engines. Other possibilities of use are also conceivable. The ignition unit installed in a four-cycle engine closes the second switch preferably in the range of the intake cycle (or intake period) and exhaust cycle. Basically, an ignition is necessary in a four-cycle engine only at every second revolution of the crankshaft.

The ignition angle of the ignition unit can be adjusted via an appropriate circuit. The circuit is dimensioned or determined in such a manner that an ignition of the fuel-air mixture takes place at high speeds further before the dead-center position of the piston. The appropriate circuit can be provided in two-cycle as well as in four-cycle engines and in other areas of application of the ignition unit in accordance with the invention.

An embodiment of the ignition unit in accordance with the invention is explained by way of example with reference made to two figures.

FIG. 1 shows the circuit of a known ignition unit. A rotating magnet wheel 1 induces alternating voltages in primary winding 2 and secondary winding 3. Magnet wheel 1 together with primary winding 2 and secondary winding 3 wound on a soft iron core forms a magnet circuit.

Primary winding 2 and a first switch 4 are components of a primary circuit. First switch 4 is an electronic switch. First switch 4 can be brought into a primary state corresponding to a closed, first switch 4. A primary current flows in the primary state of first switch 4. First switch 4 comprises a zero state corresponding to an open first switch 4. In the zero state, first switch 4 interrupts the flow of the primary current. The interruption of the flow of the primary current causes a sudden change of the magnetic flux in primary winding 2 and thus influences the magnetic circuit. As a result thereof, a secondary voltage is induced in secondary winding 3. The winding ratio of primary winding 2 and secondary winding 3 is determined in such a manner in this instance that the induced secondary voltage overcomes the resistance of a starter gap 5 and an ignition spark is generated. The ignition spark ignites a fuel-air mixture in a combustion chamber of a two-cycle engine. An ignition spark can be generated in short intervals by a constant changing of the switching state of first switch 4.

The primary current breaking down in the primary circuit after the opening of first switch 4 can be conducted into quench capacitor 6.

Starter gap 5, quench capacitor 6 and first switch 4 are connected to the frame or chassis.

Magnet wheel 1 is driven by a crankshaft of the two-cycle engine. The number of revolutions of magnet wheel 1 per time unit and the number of switching state changes of first switch 4 per time unit for generating an ignition spark are the same.

Figure 2:
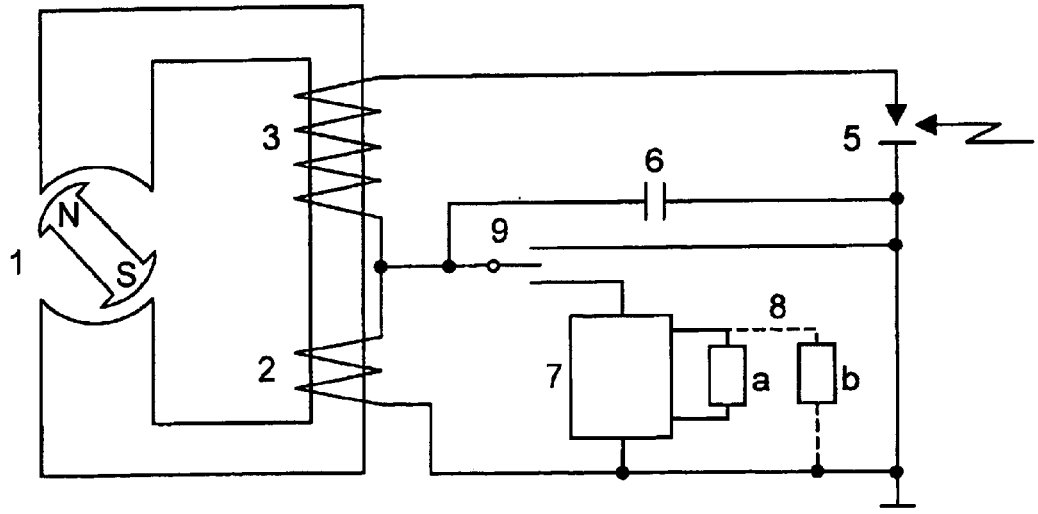
FIG. 2 is a circuit diagram of an ignition unit in accordance with the invention.

The ignition unit of the invention in accordance with FIG. 2 comprises an additional load circuit. A voltage preparation circuit 7 and a load 8 are connected into the load circuit. First switch 4 is replaced by a three-state switch 9 with primary, zero and load state. Three-state switch 9 closes the primary circuit in the primary state. In the zero state, the primary circuit and the load circuit are interrupted. In the load state of three-state switch 9 the load circuit is closed.

A regular ignition follows in the operating range of the ignition unit. This ignition is produced as described above by a change of state of or from the primary state and the zero state of three-state switch 9. The alternating frequency corresponds in this instance to the speed of the crankshaft per time unit.

In a regulated range of the ignition unit the three-state switch 9 changes over into the load state. No more ignition takes place in the regulated range and the primary current can be conducted via voltage preparation circuit 7 into a load 8. Load 8 is, e.g., a magnet valve for controlling the fuel supply of the internal combustion engine. The load can be connected in one embodiment a) by two leads to voltage preparation circuit 7 or connected in another embodiment b) by one lead to the voltage preparation circuit and by another lead to the frame.

What is claimed is:

1. An ignition unit for internal combustion engines that comprises a primary circuit with a first switch for a primary winding for generating inductions in a secondary winding of a secondary circuit with a starter gap;

said secondary winding providing energy for arcing across a spark plug;

a load circuit with the primary winding;

a second switch for a load; and a magnet wheel which is driven by a shaft of the internal combustion engine and which generates a primary current.

2. The ignition unit according to claim 1, characterized in that a quench capacitor is provided in the primary circuit.

3. The ignition unit according to claim 1, characterized in that the ignition unit has an operating range and a regulated range, wherein the first switch opens and/or closes the primary circuit in the operating range and the second switch opens and/or closes the load circuit in the regulated range.

4. The ignition unit according to claim 1, characterized in that the winding numbers of the primary winding and of the secondary winding are determined in such a manner that a sufficiently high induced voltage for an ignition spark can be generated in the secondary winding by opening the first switch.

5. The ignition unit according to claim 1, characterized in that the second switch can only be closed when the first switch of the ignition unit is open.

6. The ignition unit according to claim 1, characterized in that a three-state switch is provided that comprises the first and the second switch, wherein the three-state switch alternates between a primary state for closing the primary circuit and a zero state and a load state for closing the load circuit.

7. The ignition unit according claim 1, characterized in that a voltage preparation circuit is provided between the primary winding and the load.

8. The ignition unit according to claim 1, characterized in that the load comprises a control device for supplying fuel to the internal combustion engine.

9. The ignition unit according to claim 8, characterized in that the control device comprises a magnet valve.

10. The ignition unit according to claim 6, characterized in that the primary winding and the secondary winding comprise a first and a second end, wherein the second end of the primary winding is electrically connected to the first end of the secondary winding and the second end of the secondary winding is electrically connected via the starter gap and the quench capacitor to the second end of the primary winding and to the first end of the secondary winding, and wherein the three-state switch is connected in the primary state in parallel to the quench capacitor and in the load state in series to the voltage preparation circuit that is electrically connected to the load.

11. The ignition unit according to claim 1, characterized in that a load winding for a second load is provided.

12. The ignition unit according to claim 1, characterized in that the ignition unit is installed in a four-cycle engine and that the second switch closes the load circuit in the range of the intake cycle and exhaust cycle.

* * * * *